United States Patent [19]

Gorris et al.

[11] 4,437,864

[45] Mar. 20, 1984

[54] PLANT WITH A REACTOR CONTAINER, PARTICULARLY FOR THE GASIFICATION OF FOSSIL FUELS

[75] Inventors: Rainer Gorris, Ratingen; Josef Hibbel, Oberhausen; Ulrich Gerhardus, Oberhausen; Heinrich Scheve, Oberhausen, all of Fed. Rep. of Germany

[73] Assignees: Karrena GmbH, Düsseldorf; Ruhrchemi AG, Oberhausen; Ruhrkohle AG, Essen, all of Fed. Rep. of Germany

[21] Appl. No.: 321,171

[22] PCT Filed: Mar. 13, 1981

[86] PCT No.: PCT/DE81/00044

§ 371 Date: Nov. 9, 1981

§ 102(e) Date: Nov. 9, 1981

[87] PCT Pub. No.: WO81/02743

PCT Pub. Date: Oct. 1, 1981

[30] Foreign Application Priority Data

Mar. 14, 1980 [DE] Fed. Rep. of Germany ..... 3009851

[51] Int. Cl.[3] ..... C10J 3/20

[52] U.S. Cl. ..... 48/62 R; 48/67; 48/77; 48/87; 122/5; 122/6 A

[58] Field of Search ..... 48/62, 77, 87, 67; 122/5, 6 A

[56] References Cited

U.S. PATENT DOCUMENTS

| | | | |
|---|---|---|---|
| 2,815,007 | 12/1957 | Sprague et al. . | |
| 3,218,998 | 11/1965 | Fairman et al. . | |
| 4,126,427 | 11/1978 | Eales | 48/62 R |
| 4,129,422 | 12/1978 | Wood . | |
| 4,192,654 | 3/1980 | Brooks . | |

FOREIGN PATENT DOCUMENTS

| | | |
|---|---|---|
| 972609 | 8/1959 | Fed. Rep. of Germany . |
| 1230164 | 12/1966 | Fed. Rep. of Germany . |
| 2425962 | 8/1978 | Fed. Rep. of Germany . |
| 2751942 | 5/1979 | Fed. Rep. of Germany . |
| 2273232 | 12/1975 | France . |
| 789587 | 1/1958 | United Kingdom . |

*Primary Examiner*—Peter F. Kratz

*Attorney, Agent, or Firm*—Spencer & Frank

[57] ABSTRACT

A plant for the gasification of fossil fuels which includes a reactor container and a further plant component attachable to the reactor container. The reactor container has a discharge opening and includes a connection part extending outwardly from the discharge opening. A fireproof lining, which determines the inner cross-sectional area of the container, is provided within the container. An intermediate ring is interposed between the connecting part of the reactor container and the further plant component for attaching the connecting part to the further plant component. This intermediate ring is provided with a fireproof lining having an area of reduced inner cross-section which is less than the inner cross-sectional area of the fireproof lining of the reactor container, the area of reduced cross-section being the smallest cross-sectional area in the connection between the reactor container and the further plant component.

18 Claims, 3 Drawing Figures

PLANT WITH A REACTOR CONTAINER, PARTICULARLY FOR THE GASIFICATION OF FOSSIL FUELS

BACKGROUND OF THE INVENTION

The invention concerns a plant with a reactor container, particularly for the gasification of fossil fuels, with a fireproof lining, whose inner side limits the container interior, and with a connecting part of the reactor container which serves as connection with a further plant part, whose cross-section in the connecting area is smaller than the container cross-section.

When gasifying fossil fuels, for example when gasifying coal, very high temperatures frequently occur. The lining of a reactor container must, therefore, often withstand temperatures which amount to 1500 degrees C. or more. Even the reaction components leaving the reactor container frequently still have temperatures which are only slightly lower. Therefore, a connecting sleeve, which serves as the connection with a further plant part, must also be provided with a fireproof lining. The latter applies correspondingly to the attached conduit or plant parts.

These should always be appropriately formed in such a way that at least the direct passage outwards of the heat radiation is prevented. Additionally, it can also become necessary to prevent, quite generally, the passage of streams outwards through the lining. For these reasons, the lining in the connecting and joining area was also formed in such a way that it extends as continuously as possible in this area. In practice, this meant that the fireproof lining in the connecting and joining area could only be completed in its shape after fastening the container casing with the casing of a connecting conduit or of a plant part inserted afterward. Since this had to be done from the inside, the work required heretofore was very difficult and laborious.

On the other hand, at a given time there exists the necessity to be able to separate the reactor container from a plant part connected afterward, for example, for the purpose of repair or exchange. The disconnecting and restoring of the respective fastenings requires much time and a considerable technical expenditure.

Additionally, it can be useful for regulating certain procedures within the reactor container to alter its cross-section in the outlet area. A reduction of the outlet cross-section leads to a higher retention of the reaction components in the reactor container. The reverse applies to an increase of the outlet cross-section.

For this purpose also, it can therefore become necessary to conduct work on the fireproof lining in the connecting and joining area.

The above-noted disadvantage, that is the very great technical expenditure and especially also the considerable time requirement, also applies in this case. A large portion of the necessary time is already required to allow the reactor container to cool to such an extent that it is possible to work on the lining.

Proceeding from here, it is an object of the invention to develop a reactor container of the above-noted type in the area of its connecting sleeve in such a way that only a slight technical effort as well as, in particular, also a short assembly time is required for connecting or disconnecting of conduit or equipment parts, or also for altering the outlet cross-section of the reactor container.

SUMMARY OF THE INVENTION

In order to achieve this object, it is proposed according to the invention that an intermediate ring is inserted between the connecting part of the reactor container and the further conduit or equipment part, that the intermediate ring also contains a fireproof lining and that the clear, inner cross-section of this ring lining defines the smallest passage cross-section of the connecting area.

By means of this arrangement, several advantages are attained, one of which is that an assembly to the fireproof lining of the reactor container is not at all required for adaptation to the connecting area of another installation or conduit part or even for altering the outlet cross-section of the reactor container. The intermediate ring, in comparison to the reactor container itself, is only a relatively small structural part. This part can be kept available in several pieces and, above all, also with inner cross-sections of various sizes. If the connecting of an equipment part subsequently inserted or, on the other hand, a modification of the clear, inner cross-section in the outlet area of the reactor container is required, a replacement of the intermediate ring is sufficient. Only the connections between the outer casing of the connecting sleeve and the outer casing of the intermediate ring need be disconnected, whereby the reactor container, if necessary, must be raised a little. These operations can take place after a substantially shorter cooling time, because it is not necessary to work directly on the lining itself, which is the hottest area. It is especially advantageous that all work can be undertaken from the outside. The lining of the intermediate ring can, in a simple manner, always maintain such a shape, that a more or less continuous lining is guaranteed at the transition points to the connecting sleeves and also to the conduit or equipment part connected to the device.

Moreover, it is advantageous in accordance with the invention if the cross-section of the ring lining increases in funnel-like fashion from the smallest cross-sectional area in the direction of the connecting part. The lining of the connecting part can be formed hereby in such a way that it protrudes a bit out of the outer casing thereof. Therewith, an overlapping of the lining of the connecting sleeve with the ring lining in a radial direction is guaranteed, so that a direct passage of heat radiation outwards is not possible.

Pursuant to an advantageous embodiment of the invention, it is further recommended that the lining of the connecting part is held in cantilevered fashion by means of a support structure fastened to the reactor container and that a ring chamber is formed between the lining and the outer casing of the connecting sleeve. When the lining of the connecting sleeve protrudes into the intermediate ring, then room is made for fastening of the ring lining by this open space which is formed in a radial direction.

It can often be necessary to cool the fireproof lining. In this case, an advantageous embodiment of the invention can exist in that the support structure is formed by cooling pipes running at least approximately parallel to the axis of the connecting part. These can be arranged, evenly distributed, around the periphery, so that they form a structurally stable cage which surrounds the lining or, at least, an innermost layer thereof.

In such an arrangement, the cooling pipes can hereby discharge into a ring collector, at least at their ends turned toward the reactor container, whereby the ring collector can be slightly moveable in the radial direction. The latter serves the purpose of enabling an equalization of variously sized heat expansions between the support structure, consisting of the cooling pipes and the ring collector on the one hand and the lining on the other hand.

In accordance with the invention, it can be advantageous for the formation of the intermediate ring if the ring lining is held at the outer casing of the intermediate ring by means of a support structure and otherwise is self-supporting. The self-supporting suspension, both of the lining of the connecting sleeve and of the ring lining, enables as small a connection area as possible between the lining and the outer casing, so that precautions for equalization of differently sized heat expansions need only be taken in this area.

According to the invention, for the formation of the intermediate ring it is further suggested that the support structure for the ring lining is also formed by cooling pipes, that a ring collector is fastened to the end of the intermediate ring turned toward the reactor container, into which the ends of the cooling pipes turned toward the ring collector open, and that this ring container, with a mounted intermediate ring, surrounds the lining protruding from the connecting part. The lining of the connecting sleeve can thus be led up into the cooled area of the intermediate ring and its lining.

Pursuant to an advantageous embodiment, the ring lining is surrounded, in the area of its smallest cross-section, by a ring collector into which the other ends of the cooling pipes run. Thereby, the ring collector itself contributes to the direct cooling in the narrowest cross-section of the ring lining, whereby it simultaneously provides a good structural support to the middle area of the intermediate ring. The cooling pipes can also be led in a very advantageous manner, that is, in such a way that the ring lining also expands in funnel-like fashion from the narrowest cross-section in the direction of the end of the intermediate ring turned away from the reactor container. Also, that the cooling pipes run outside of the ring collector, fastened at the level of the narrowest lining cross-section, until approximately the lower end of the funnel-shaped widening, and that the cooling pipes are led back from there, bending inwardly, in the direction of the ring collector. Hereby, the cage formed by the cooling pipes acquires a relatively closed cylinder shape up to the end of the intermediate ring which is turned away from the reactor container. This enables the insertion of the ring lining in a conduit or equipment part connected to the device with a relatively slight clearance, so that the ring lining also can form a good transition with the lining of the conduit or equipment part connected to the device. Pursuant to the invention, it is hereby advantageous if the end of the ring lining turned away from the reactor container protrudes a bit from the outer casing of the intermediate ring.

If required, the fireproof lining of the connecting sleeve and of the intermediate ring can be made completely or partially from fireproof bricks or from a fireproof building material. Particularly for the intermediate ring, the use of building material can result in advantages. If the lining consists of a fireproof building material, the cooling pipes and/or plates arranged between these and/or the ring collector can be practically provided with anchors, which protrude into the building material layer. The anchors can be fastened to these parts by means of simple welding.

Further, gas barriers, consisting at least partially of flexible material, can be arranged between the lining or its support structure and the outer casing, in order to prevent the entrance of gas streams into the space found between the lining and the outer casing.

BRIEF DESCRIPTION OF THE DRAWINGS

In the following, a particularly preferred embodiment of the invention is described in greater detail with reference to the accompanying drawing wherein.

DESCRIPTION OF THE PREFERRED EMBODIMENT

Figure 1:
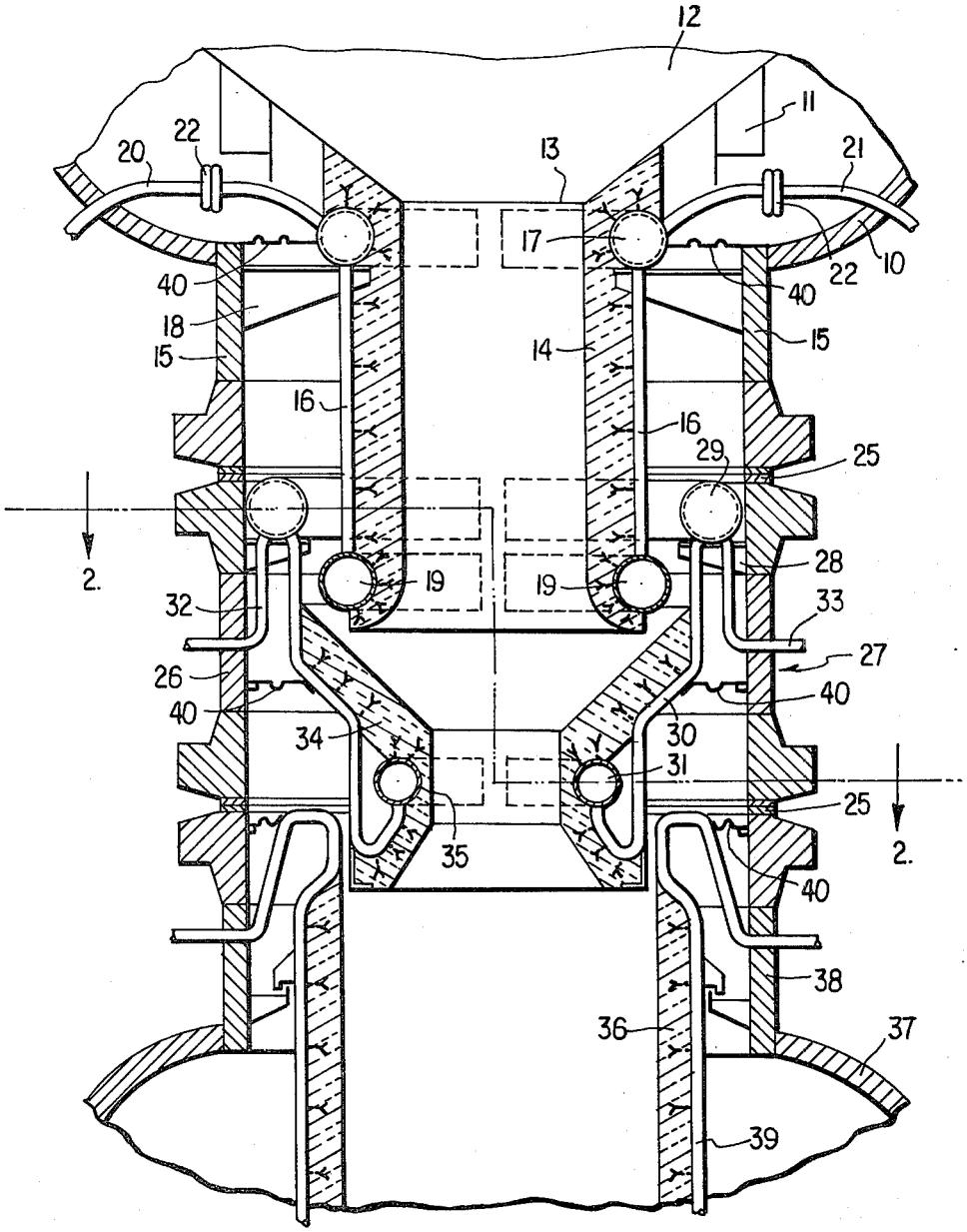
FIG. 1 shows a schematic longitudinal section through the connecting and joining area of a reactor container with an equipment part inserted thereafter.

In FIG. 1, only the lower part of a reactor container arranged in a vertical position is shown which has an outer, pressure resistant casing 10 and an inner lining 11 of fireproof material. The cross-section of the container interior tapers conically downward to a discharge opening 13, which corresponds to the clear, inner cross-section of an outlet support. The latter has an inner lining 14 of a fireproof building material as well as an outer, pressure resistant casing 15, which is fastened at the lower end of the reactor container to the casing 10 thereof.

The lining 14 of building material is supported by a cage formed from cooling pipes 16. The upper ends of the cooling pipes 16 empty into a ring collector 17, which is positioned on brackets 18. The lower ends of the cooling pipes 16 are connected with a further ring collector 19. The upper ring collector 17 is subdivided into at least two sections in its course over the periphery. The left section in FIG. 1 is joined with a feed pipe 20, whereas the right section in FIG. 1 is connected with a drainage 21. The feed pipe 20 and the drain pipe 21 lead to a central coolant supply which is not shown here. In order to equalize the heat expansions, compensators 22 are inserted into the feed pipe 20 and the drain pipe 21 respectively.

Figure 2:
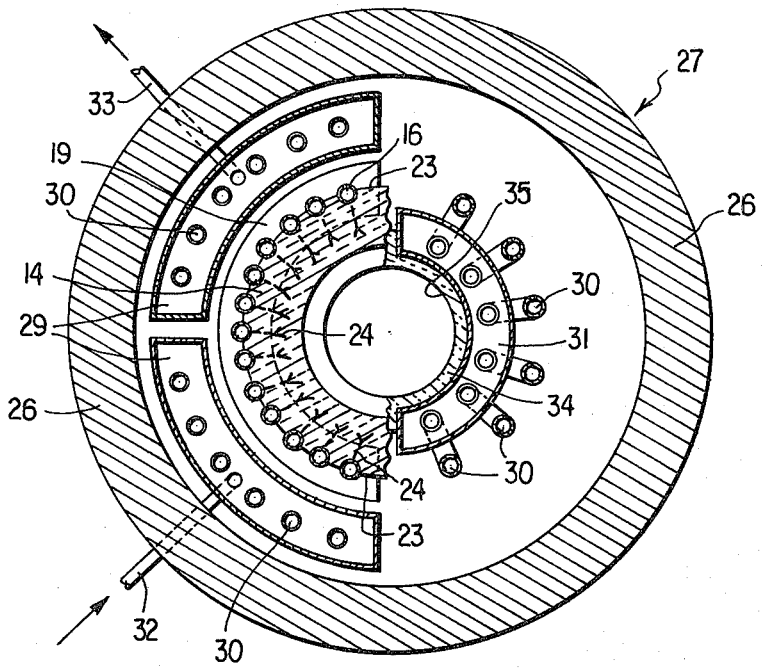
FIG. 2 is a cross-section along the line II—II in FIG. 1, with two parts situated in different levels.

As can be seen in FIG. 2, the cooling pipes 16 are joined to one another in a peripheral direction by plates 23. Mass anchors 24 are welded to the cooling pipes 16 and also to the ring collectors 17 and 19. These mass anchors extend into the lining 14 with their ends, which are spread apart, and firmly fasten these with the cage formed from the cooling pipes 16 and ring collectors 17 and 19. A movement of the ring collector 17 in the radial direction is enabled by positioning the upper ring collector 17 on the bracket 18, so that room is available for admission of heat expansions. The lining 14 is, therefore, freely suspended over the ring collector 17 in the connecting sleeve, such that it slightly overlaps the lower end of the casing 15.

Figure 3:
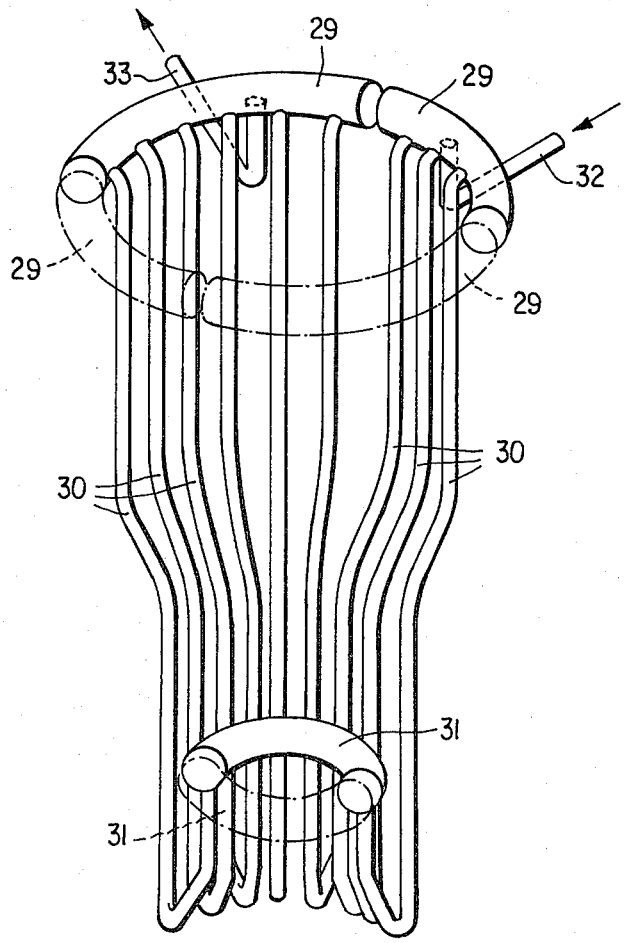
FIG. 3 is a view of the cage formed by the cooling pipes in the intermediate ring.

With the use of sealing rings 25, the outer casing 26 of an intermediate ring 27 is flanged to the casing 15 of the connecting sleeve. The intermediate ring 27 has, in detail, the following structure:

At the level of the upper end of the casing 26, on the inside thereof, are provided brackets 28 on which a ring collector 29 rests. This one also is subdivided over the periphery into sections, which each reach over an arc angle of 90 degrees. From the ring collector 29, cooling pipes 30 proceed which at first extend, over a short section, vertically downwardly, then downwardly and inwardly, and subsequently vertically downwardly again, until they finally bend inwardly and upwardly with their ends and discharge into a further ring collector 31. The latter is subdivided over its periphery into two sections, each comprising an arc angle of 180 degrees. The structure of the cage, consisting of the cooling pipes 30 and the ring collectors 29 and 31, can especially also be seen in FIG. 3, which shows this cage for a peripheral area of 180 degrees. A feed pipe 32 discharges into the right section of the upper ring collector 29 in FIG. 3. The coolant flows through the cooling pipes 30, which proceed from this section into the lower ring collector 31 and from this one back into the right section of the upper ring collector 29 in FIG. 3. From there, the coolant is led back over a drain pipe 33 either to a central coolant supply or else conducted to the other half of the cooling system formed in the intermediate ring 27.

The ring collectors 29 and 31 as well as the cooling pipes 30 are also provided with mass anchors 24, which support a lining 34 consisting of a fireproof building material. Whereas the upper ring collector 29 is arranged at the level of a ring chamber formed between the lining 14 of the connecting sleeve and the casing 15 thereof, or the casing 26 of the intermediate ring, the lining 34 begins a little lower with a funnel-shaped expansion which tapers downward to an area 35 of the narrowest cross-section. At the level of this area 35, the lower ring collector 31 is also disposed. The area 35 represents the smallest cross-section at the outlet side of the reactor container and expands downward, also in a funnel-like fashion.

Thus, the lining 34 of the intermediate ring 27 is also freely supported at the upper ring collector 29, whereby the ring collector 29 is supported by the brackets 28 to permit a slight movement in the radial direction, so that the stresses due to heat expansions are not transmitted outward.

The lining 34 projects a bit over the lower end of the casing 26 of the intermediate ring 27 and protrudes with its lower end into a fireproof lining 36, which belongs to an equipment part, that is, a further plant component, disposed downstream. The latter also has the shape of a container with an outer casing 37, which merges at its upper end with the casing 38 of a connecting sleeve. The latter is adjusted in its diameter to the casing 26 of the intermediate ring 27, so that here also the casing 38 of the connecting sleeve can be screwed together with the casing 26 of the intermediate ring 27 by using sealing rings 25.

The lining 36 is, moreover, also held at a cage formed out of cooling pipes 39 and freely suspended.

As seen in FIG. 1, the linings 14, 34 and 36 have such a shape and arrangement that the reaction components passing out of the reactor container can reach into the container connected downstream, without direct heat radiation being able to penetrate outward in a radial direction. Additionally, gas barriers 40 are also provided, which consist at least partially of elastic material and which form a sealing member over the periphery between the inner linings 14, 34 and 36, on the one hand, and the respective outer casings 15, 26 and 38, on the other hand.

In order to loosen and dismantle the connection, the upper reactor container only has to be raised a little after loosening the flange connection, so that the intermediate ring 27 can be removed, inserted or replaced by another intermediate ring. Work on the linings 14, 34 and 36 themselves is not required hereby.

In the shown embodiment, the mass anchors 24 consist of steel and are fastened by welding. It is, however, also conceivable to use anchors of similar shape or anchor stones which consist of ceramic material and are fastened to the casing, for example, with suitable steel clamps.

We claim:

1. A plant for the gasification of fossil fuels which includes a reactor container and a further plant component attached to said container, said reactor container having a longitudinal axis, a fireproof lining which determines the inner cross-sectional area of said container, a discharge opening and a connecting part extending outwardly from said discharge opening, said connecting part having an outer casing surrounding a fireproof lining thereof and forming an annular space therebetween;

wherein, the improvement comprises an intermediate ring interposed between said connecting part and said further plant component for attaching said connecting part to said further plant component, said intermediate ring including a fireproof lining having a reduced inner cross-sectional area at a portion thereof which is less than the inner cross-sectional area of the fireproof lining of said reactor container, said reduced cross-sectional area being the smallest cross-sectional area of the connection between said reactor container and said further plant component;

and wherein said intermediate ring further includes an outer casing surrounding the fireproof lining thereof and forming an annular space therebetween, the outer casing of said intermediate ring having one end adjacent the outer casing of said connecting part and being sealingly engaged therewith;

and which plant further comprises a support structure attached to the outer casing of said intermediate ring and the fireproof lining of said ring for suspending the fireproof lining of said intermediate ring.

2. A plant according to claim 1 wherein the fireproof lining of said intermediate ring has a tapered cross-sectional area, the cross-sectional area of the portion of said lining adjacent said connecting part being greater than said area of reduced cross-section.

3. A plant according to claim 1 or 2 wherein the fireproof lining of said connecting part extends along said longitudinal axis beyond the end of the outer casing located adjacent said intermediate ring.

4. A plant according to claim 1 or 2 wherein said plant further comprises a support structure attached to said reactor container and to the fireproof lining of said connecting part, said support structure freely suspending the fireproof lining of said connecting part in a ring chamber defined by the outer casing and the fireproof lining of said connecting part.

5. A plant according to claim 4 wherein said support structures include a plurality of cooling pipes extending in a direction substantially parallel to said longitudinal axis.

6. A plant according to claim 18 wherein the support structure attached to said reactor container and to the fireproof lining of said connecting part further comprises a ring collector mounted adjacent the discharge opening of said reactor container and being coupled to the ends of said plurality of cooling pipes, said ring collector being mounted for slight movement in a radial direction perpendicular to said longitudinal axis.

7. A plant according to claim 1 wherein the support structure attached to the outer casing of said intermediate ring and the fireproof lining of said intermediate ring freely suspends the fireproof lining of said intermediate ring.

8. A plant according to claim 7 wherein the fireproof lining of said connecting part extends along said longitudinal axis beyond the end of the outer casing thereof located adjacent said intermediate ring; and wherein said support structure comprises a plurality of cooling pipes and a ring collector surrounding that portion of the fireproof lining of the connecting part which extends beyond the end of the outer casing thereof, one end of each of said cooling pipes being coupled to said ring collector.

9. A plant according to claim 8 wherein a second ring collector surrounds the area of reduced cross-section of the fireproof lining of said intermediate ring, the other end of each of said cooling pipes being coupled to said second ring collector.

10. A plant according to claim 1 wherein said support structure including a plurality of cooling pipes and a ring collector surrounding the area of reduced cross-section of the fireproof lining of said intermediate ring, the ends of said cooling pipes being coupled to said ring collector.

11. A plant according to claim 9 wherein the fireproof lining of said intermediate ring has a tapered cross-sectional area, the cross-sectional area of the portion of said lining adjacent said further plant component being greater than said area of reduced cross-section; and wherein said cooling pipes extend from said second ring collector toward the portion of said lining having said greater cross-sectional area and then back toward said second ring collector.

12. A plant according to claim 1 wherein the fireproof lining of said intermediate ring extends, along said longitudinal axis in the direction toward said further plant component, beyond the end of said outer casing.

13. A plant according to claim 8 wherein the fireproof lining of said intermediate ring extends, along said longitudinal axis in the direction toward said further plant component, beyond the end of the outer casing of said intermediate ring.

14. A plant according to claim 5 wherein said fireproof linings are composed of a fireproof building material and which further comprises anchors securing said cooling pipes to said building material.

15. A plant according to claim 8 or 11 wherein said fireproof linings are composed of a fireproof building material, and which further comprises anchors securing said cooling pipes and said ring collector to said building material.

16. A plant according to claim 1 which further comprises gas barriers consisting at least partially of flexible material positioned between the outer casing and fireproof lining of said connecting part and between the outer casing and fireproof lining of said intermediate ring respectively.

17. A plant according to claim 4 which further comprises gas barriers consisting at least partially of flexible material positioned between the outer casing and fireproof lining of said connecting part.

18. A plant according to claim 7 which further comprises gas barriers consisting at least partially of flexible material positioned between the outer casing and fireproof lining of said intermediate ring.

* * * * *